United States Patent [19]

Yasuda

[11] Patent Number: 4,919,155

[45] Date of Patent: Apr. 24, 1990

[54] HAIR CLIP

[76] Inventor: Masahiro Yasuda, 22-6, Dairenminami 1-chome, Higashi Osakashi, Osaka, Japan

[21] Appl. No.: 320,565

[22] Filed: Mar. 8, 1989

[30] Foreign Application Priority Data

Mar. 11, 1988 [JP] Japan ..... 63-58695

[51] Int. Cl.[5] ..... A45D 8/28

[52] U.S. Cl. ..... 132/278; 132/279

[58] Field of Search ..... 132/273, 275, 276, 278, 132/279

[56] References Cited

U.S. PATENT DOCUMENTS

| | | | |
|---|---|---|---|
| 2,164,940 | 7/1939 | Polak | 132/278 |
| 2,921,589 | 1/1960 | Blomme | 132/279 |
| 3,565,084 | 2/1971 | Vuillard | 132/279 |
| 3,704,717 | 12/1972 | Morand et al. | 132/279 |
| 3,805,813 | 4/1974 | Laughton | 132/279 |
| 3,841,340 | 10/1974 | Solomon | 132/279 |

FOREIGN PATENT DOCUMENTS

| | | | |
|---|---|---|---|
| 1222694 | 6/1960 | France | 132/279 |

*Primary Examiner*—John Weiss
*Assistant Examiner*—Adriene J. Lepiane

[57] ABSTRACT

A hair clip includes a base plate, a spring board and a hair retainer rotatably connected to the base plate at its one end, the hair retainer having an engaging part whereby its free end is latched to the base plate such that the hair retainer is readily unlatched by fingers.

6 Claims, 3 Drawing Sheets

HAIR CLIP

BACKGROUND OF THE INVENTION

The present invention relates to a hair clip and more particularly to an ornamental hair clip for retaining hairs by and between two metal sheets by a spring force.

There are many kinds of hair clips known in the art, which, in common with them, include a base plate fixed to an ornamental cover, a downwardly curved spring board whose both ends are fixed to the base plate, and a retainer whose one end is rotatively connected to the base plate with the other end being releasably latched to the base plate. For example, Japanese Utility Model Publication (unexamined) Nos. 45-3321, 50-47698, 50-154195, 57-55403 and 81-174504 disclose hair clips of such kinds.

These known clips retain hairs by and between the spring board and the retainer, and when the hairs are to be released from the clip, the end of the retainer is unlatched from the base plate by hand.

However, a disadvantage arises when the hair is released from the clip, in that the retainer must be unlatched from the base plate by inserting at least the forefinger and thumb into underneath the ornamental member. Especially when the ornamental member is relatively large, the hair release becomes more difficult because of such a large spacing between the periphery of the ornamental member and the latched part of the retainer as to be out of fingers' reach. If the fingers are unnaturally stretched, they loses force sufficient& to unlatch the retainer from the base plate.

SUMMARY OF THE INVENTION

The present invention is directed toward a hair clip which solves the problem pointed out with respect to the known hair clips. Thus an object of the present invention is to provide a hair clip capable of facilitating the hair release from the clip.

According to the present invention there is provided a hair clip comprising a base plate including a pair of brackets at one end, and a pair of ledges at the other end, a hair retainer rotatively connected to the brackets of the base plate the ledges including a pair of arms capable of overlapping in accordance with the forced entry of the hair retainer the hair retainer comprising an engaging part including a first means for accepting the arms of the ledges in their overlapping state and a second means for releasing them from the first means.

Other objects and advantages of the present invention will become more apparent from the following detailed description, when taken in conjunction with the accompanying drawings which show, for the purpose of illustration only, one embodiment in accordance with the present invention.

DETAILED DESCRIPTION OF THE INVENTION

Figure 1:
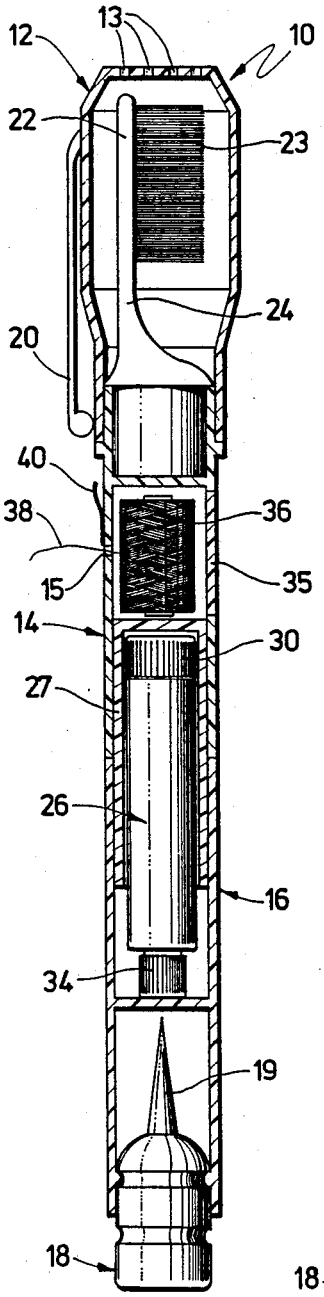
FIG. 1 is a side view showing an assembly of an ornamental cover and a hair clip according to the present invention.
Figure 2:
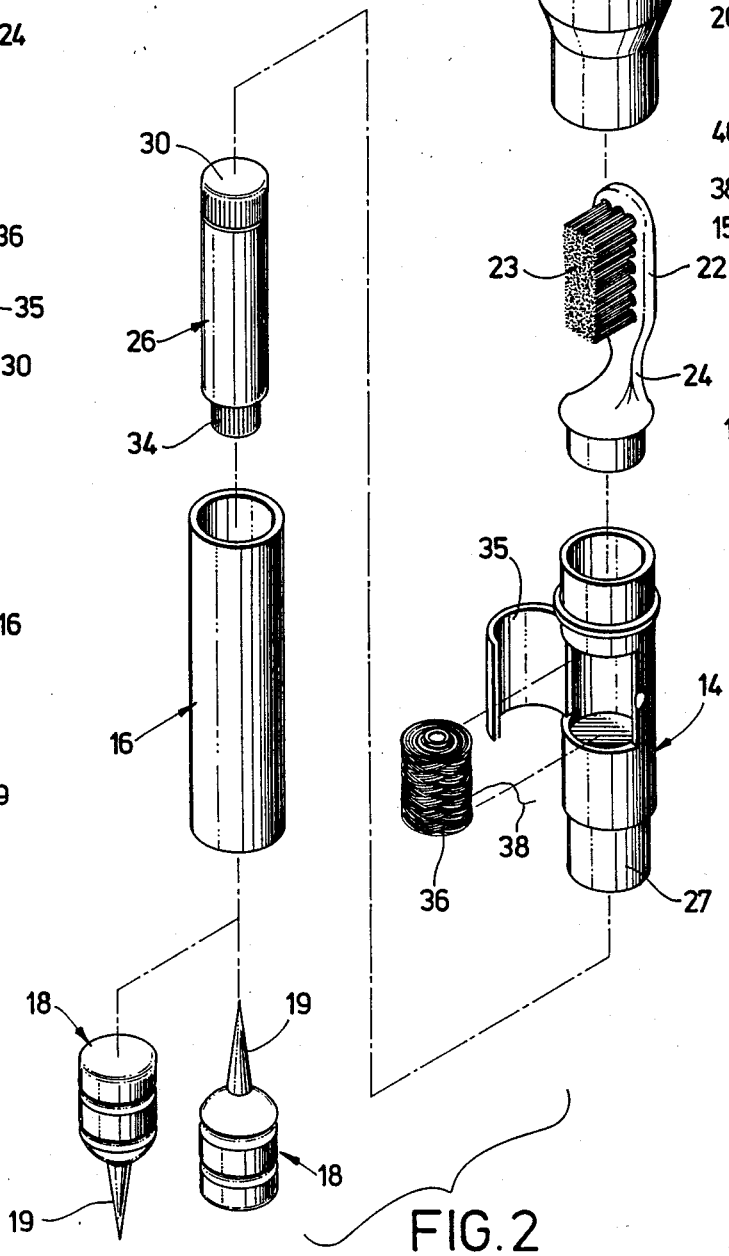
FIG. 2 is a cross-sectional view taken along the line II—II in FIG. 1.
Figure 3:
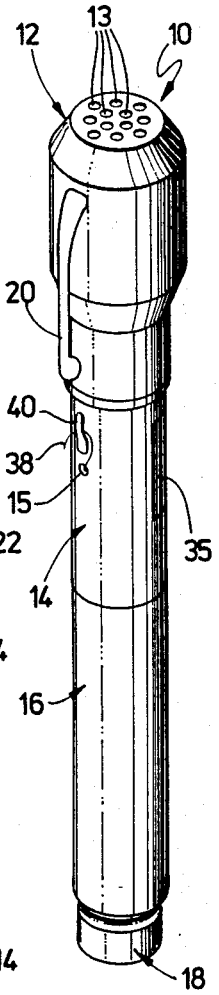
FIG. 3 is a perspective view, viewed from below, showing the base plate shown in FIG. 1.
Figure 4:
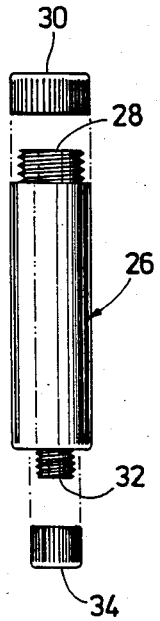
FIG. 4 is a perspective view showing the spring board shown in FIG. 1.
Figure 1:
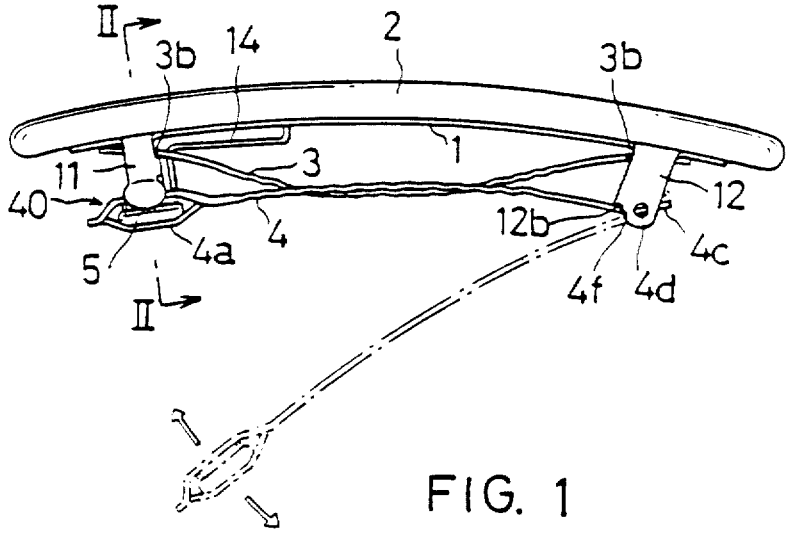
Figure 2:
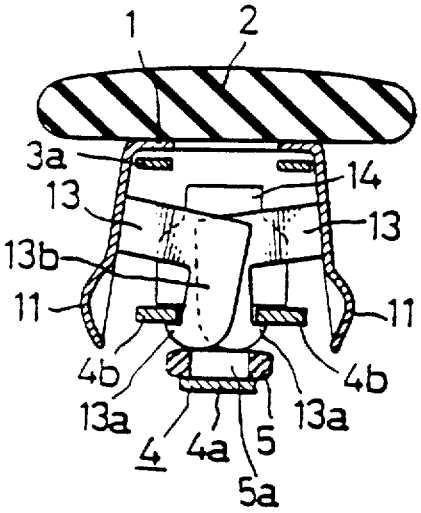
Figure 3:
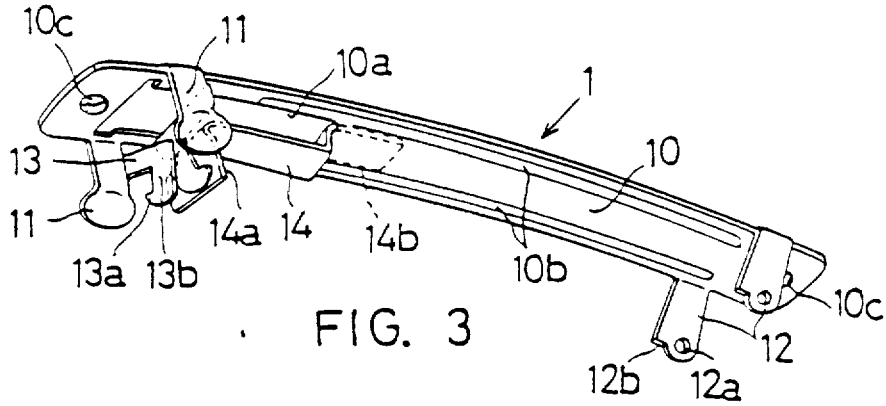
Figure 4:
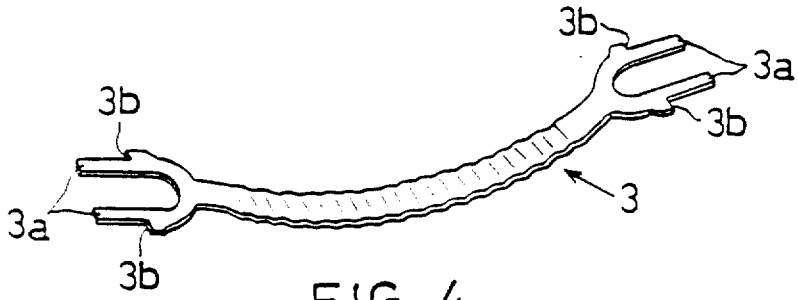
Figure 5:
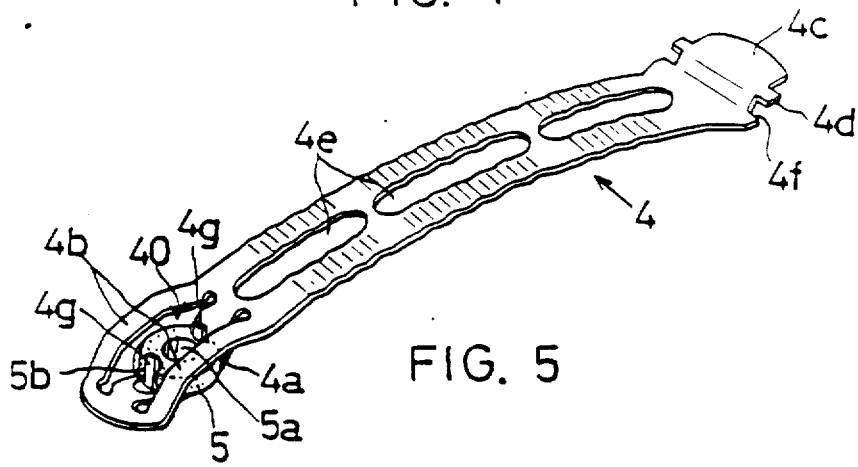
FIG. 5 is a perspective view showing the retainer shown in FIG. 1.

Referring to FIG. 1 to 5, which show one embodiment of the present invention, it will be seen that the hair clip of the present invention comprises a base plate 1, a spring board 3 and a hair retainer 4, hereinafter referred to as the retainer. The base plate 1, made of a spring steel or the like, is curved upward, and includes a sheet portion 10, a pair of ledges 11 at one end and a pair of brackets 12 at the other end. Each ledge 11 is provided with an L-shaped arm 13 including a vertical leg portion **13*b* having a round end 13*a*. The arms 13*a* face each other, and overlap in accordance with the forced entry of the retainer as shown in FIG. 2. The brackets 12 include apertures 12*a* at their terminating ends which have shoulders 12*b* as best shown in FIG. 3. The sheet portion 10 is provided with ridges 10*b* having a slot 10*a* toward the ledges 11. The reference numeral 14 denotes an auxiliary spring board for facilitating the unlatching of the retainer from the base plate, the spring board 14 including a flat portion 14*b* which is jointed to the base plate 1 and a downward flap 14*a* situated behind the arms 13 as best shown in FIG. 3. The base plate 1 is detachably fixed to an ornamental cover 2 of plastics by means of screws (not shown) through holes 10*c***.

The spring board 3, made of spring steel, is slightly arched, and includes horseshoe-shaped portions **3*a* each having stepped shoulders 3*b* at opposite ends. The spring board 3 is engaged with the brackets 12 and the ledges 11 of the base plate 1, wherein the stepped shoulders 3*b* secure the spring board 3 in position. The spring board 3 includes a rugged surface on either side of the portion between the opposite horseshoe portions 3*a***.

The retainer 4 is also made of sprinq steel and provided with three slots **4*e* spaced from each other. In addition the retainer 4 is provided with an engaging part 40 at one end and a journal part 4*c* at the other end. The engaging part 40 includes a pair of arched bridges 4*b* with a dented part 4*a* interposed therebetween, and the journal part 4*c* includes pivot portions 4*d* and shoulders 4*f*. The pivot portions 4*d* are fitted in the apertures 12*a* of the bracket 12 such that the retainer 4 can rotate about the pivot portions 4*d*. The movement of the retainer 4 toward the ledges 11 is restricted by the engagement of the shoulders 4*f* thereof with the shoulders 12*b* of the brackets 12. The retainer 4** has a rugged surface on either side.

Figure 8:
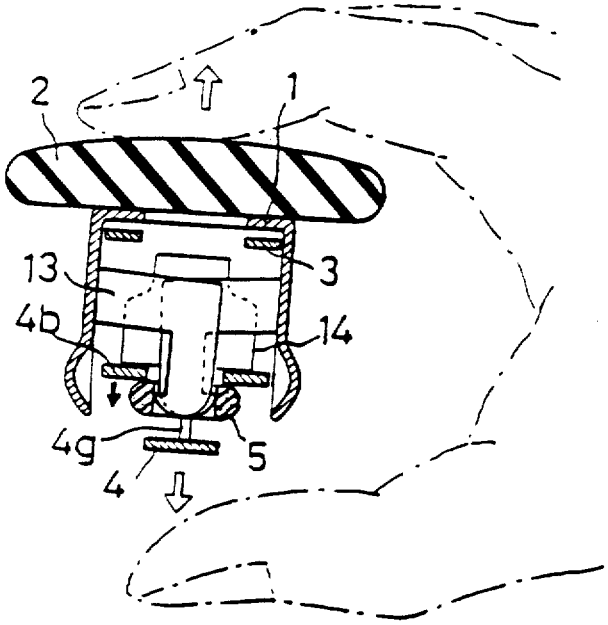

The retainer 4 is provided with a ring 5 placed on the dented part **4*a* of the engaging part 40. To secure the ring 5, the dented part 4*a* is provided with a pair of guide posts 4*g* adapted to fit in slots 5*b* produced on the periphery of the ring 5. The ring 5 includes a hole 5*a* whose diameter is such as to allow the overlapping round ends 13*a* of the arms 13 to fit in as best shown in FIG. 8. Likewise, the distance between the two arched bridges 4*b* is such as to allow the overlapping round ends 13*a* of the arms 13 to pass through as shown in FIG. 2. The retainer 4, which is latched to the ledges 11, is allowed to move within the length of the vertical leg portions 13*b* of the L-shaped arms 13**.

The retainer 4 is rotated about the pivot portions **4*d* fitted in the apertures 12*a* of the brackets 12 toward the base plate 1, in the course of which the retainer 4 comes into contact with the spring board 3, and finally becomes latched to the ledges 11 with the spring board 3 placed against the base plate 1. While the retainer 4 is latched to the ledges 11, the auxiliary spring board 14 biases the retainer toward unlatching it therefrom. As the forced entry of the engaging part of the retainer advances, the round ends 13***a* of the arms 13 overlap and pass through a gap between the arched bridges 4*b*. At this stage the ring 5 stays on the dented part 4*a* as shown in FIG. 2. In this way the retainer 4 is latched to the ledges 11.

When the retainer 4 is to be released from the ledges 11, there can be two ways. One way is to press the ledges 11 horizontally toward each other by fingers, thereby enabling the arms 13 to overlap excessively enough to release out of the gap between the arched bridges 4*b*.

Figure 7:
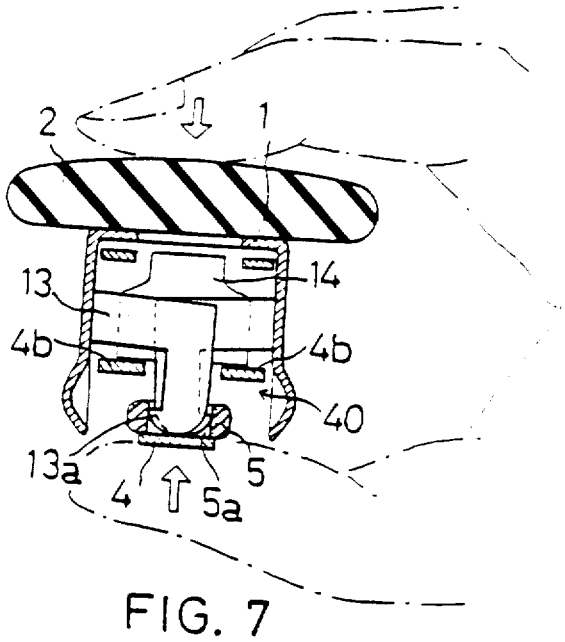
Figure 9:
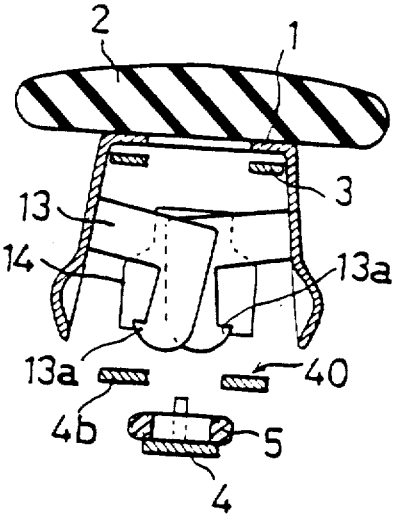

The other way to release the retainer from the ledges 11 is to pinch the retainer 4 from top and bottom as shown in FIG. 8. The arms 13 come into engagement with a peripheral rim 5*c* of the hole 5*a*, and finally the round ends 13*a* thereof fit in the hole 5*a* as shown in FIG. 7. At this stage the round ends 13*a* are fully separated from the arched bridges 4*b*. Then the fingers are gradually separated from the hair clip as shown in FIG. 8 thereby allowing the retainer 4 to move downward under the action of the springs 3 and 14 as shown in FIG. 8. Finally the round ends 13*a* of the arms 13 become separated from the ring 5 and the engaging part 40 as shown in FIG. 9.

As is evident from the foregoing description, the hair can be easily released from the hair retainer by pinching the clip with fingers. No strong force is required.

What is claimed is:

1. A hair clip comprising:

a base plate including a pair of brackets at one end and a pair of ledges at the other end;

a hair retainer rotatably connected to the brackets at one end, said hair retainer having an engaging portion at the other end;

a pair of arms projecting inwards from the insides of the ledges, each arm including a leg portion capable of overlapping with the leg portion of the other arm;

said engaging portion including a central dented part and a pair of arched bridge parts at opposite sides of the dented part; and a ring placed between the central dented part and the arched bridge parts, said ring having a central opening for allowing the leg portions of the arms to fit in when they overlap with each other for unlatching.

2. The hair clip of claim 1, wherein said ring includes a pair of slots disposed in diametrically opposed peripheral parts thereof, said slots receiving guide posts disposed on the central dented part so that the ring is vertically slidable, but prevented from moving in an axial direction of the central dented part.

3. The hair clip of claim 2, wherein the central opening in the ring is a hole with a diameter not larger than the distance between the bridge parts.

4. The hair clip of claim 1, wherein the central opening of the ring is a hole with a diameter not larger than the distance between the arched bridge parts.

5. The hair clip of claim 1, wherein each of the leg portions has a rounded end portion.

6. The hair clip of claim 1, 2, 3, 4, or 5 further comprising an auxiliary spring board whose one end is fixedly secured to said base plate so as to bias the retainer from the base plate when hair release is effected.

* * * * *

UNITED STATES PATENT AND TRADEMARK OFFICE

CERTIFICATE OF CORRECTION

PATENT NO. : 4,919,155

DATED : April 24, 1990

INVENTOR(S) : Masahiro Yasuda

It is certified that error appears in the above-identified patent and that said Letters Patent is hereby corrected as shown below:

The title page should be deleted to appear as per attached title page.

In the drawings, substitute the attached drawings for those included in the patent.

Signed and Sealed this

Seventeenth Day of December, 1991

*Attest:*

HARRY F. MANBECK, JR.

*Attesting Officer*

*Commissioner of Patents and Trademarks*

United States Patent [19]

Yasuda

[11] Patent Number: 4,919,155

[45] Date of Patent: Apr. 24, 1990

[54] HAIR CLIP

[76] Inventor: Masahiro Yasuda, 22-6, Dairenminami 1-chome, Higashi Osakashi, Osaka, Japan

[21] Appl. No.: 320,565

[22] Filed: Mar. 8, 1989

[30] Foreign Application Priority Data

Mar. 11, 1988 [JP] Japan ..... 63-58695

[51] Int. Cl.[5] ..... A45D 8/28

[52] U.S. Cl. ..... 132/278; 132/279

[58] Field of Search ..... 132/273, 275, 276, 278, 132/279

[56] References Cited

U.S. PATENT DOCUMENTS

| | | | |
|---|---|---|---|
| 2,164,940 | 7/1939 | Polak | 132/278 |
| 2,921,589 | 1/1960 | Blomme | 132/279 |
| 3,565,084 | 2/1971 | Vuillard | 132/279 |
| 3,704,717 | 12/1972 | Morand et al. | 132/279 |
| 3,805,813 | 4/1974 | Laughton | 132/279 |
| 3,841,340 | 10/1974 | Solomon | 132/279 |

FOREIGN PATENT DOCUMENTS

| | | | |
|---|---|---|---|
| 1222694 | 6/1960 | France | 132/279 |

*Primary Examiner*—John Weiss
*Assistant Examiner*—Adriene J. Lepiane

[57] ABSTRACT

A hair clip includes a base plate, a spring board and a hair retainer rotatably connected to the base plate at its one end, the hair retainer having an engaging part whereby its free end is latched to the base plate such that the hair retainer is readily unlatched by fingers.

6 Claims, 1 Drawing Sheet

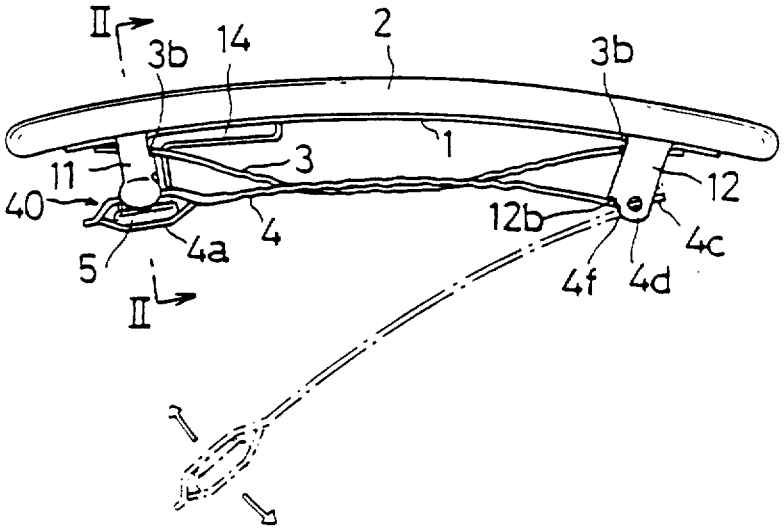

UNITED STATES PATENT AND TRADEMARK OFFICE

CERTIFICATE OF CORRECTION

PATENT NO. : 4,919,155

DATED : April 24, 1990

INVENTOR(S) : Masahiro Yasuda

It is certified that error appears in the above-identified patent and that said Letters Patent is hereby corrected as shown below:

Column 1, line 17, delete "81-174504" and substitute therefor -- 61-174504 --.

Column 1, line 32, delete "sufficient&" and substitute therefor -- sufficient --.

Column 1, line 45, after "plate" insert -- , --.

Column 1, line 47, after "retainer" insert --,--.

Column 1, line 49, after "state" insert -- , --.

Column 2, line 21, after "ends" insert -- , --.

Column 2, line 41, after "addition" insert -- , --.

Figure 6:
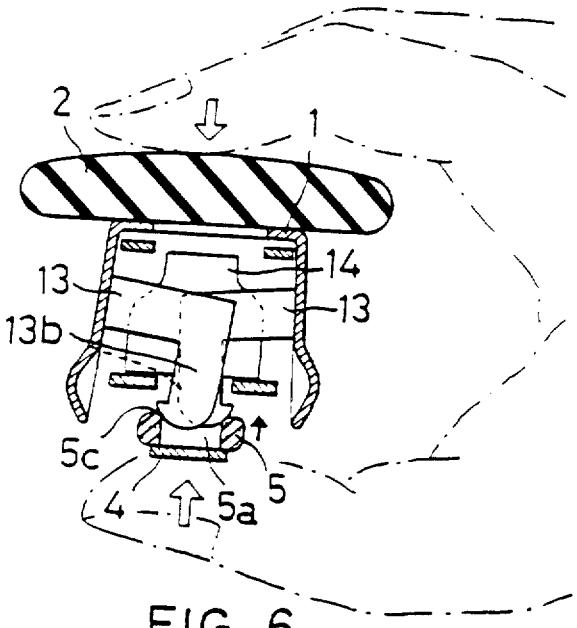
FIGS. 6 to 9 are perspective views showing an operation of hair release from the clip.

Column 3, line 20, delete "FIG.8" and substitute therefor -- FIG. 6 --.

Column 3, line 26, after "8" insert -- , --.

Column 4, line 3, delete "rotatably" and substitute therefor -- rotatively --.